United States Patent [19]

Daude et al.

[11] 4,356,886

[45] Nov. 2, 1982

[54] EXTERNAL HOUSING FOR AN EXHAUST MUFFLER FOR INTERNAL COMBUSTION ENGINES

[75] Inventors: Otto Daude, Bovenden; Heinz Peckmann, Göttingen, both of Fed. Rep. of Germany

[73] Assignee: Alcan Aluminiumwerke GmbH, Göttingen, Fed. Rep. of Germany

[21] Appl. No.: 170,728

[22] Filed: Jul. 21, 1980

[30] Foreign Application Priority Data

Jul. 24, 1979 [DE] Fed. Rep. of Germany ..... 2930046

[51] Int. Cl.[3] ..... F01N 1/04; F01N 7/18

[52] U.S. Cl. ..... 181/250; 181/252; 181/282

[58] Field of Search ..... 181/249, 250, 252, 255, 181/269, 272, 273, 282, 283, 266, 276; 72/253.1, 254, 267

[56] References Cited

U.S. PATENT DOCUMENTS

| | | | |
|---|---|---|---|
| 1,682,316 | 8/1928 | Williams | 181/281 |
| 1,972,065 | 8/1934 | Noblitt | 181/249 |
| 2,583,366 | 1/1952 | Engels | 181/252 |
| 3,381,774 | 5/1968 | Stade et al. | 181/272 |
| 3,590,945 | 7/1971 | Murphy | 181/278 X |
| 4,213,414 | 7/1980 | Sato et al. | 181/249 X |

FOREIGN PATENT DOCUMENTS

| | | |
|---|---|---|
| 2520301 | 11/1976 | Fed. Rep. of Germany . |
| 2621474 | 12/1976 | Fed. Rep. of Germany . |
| 2653732 | 6/1978 | Fed. Rep. of Germany . |

OTHER PUBLICATIONS

Ziegler, "How to Design Aluminum Impact Extrusions", *Machine Design*, Mar. 19, 1959, pp. 204, 206, 208, 210.

*Primary Examiner*—L. T. Hix
*Assistant Examiner*—Thomas H. Tarcza
*Attorney, Agent, or Firm*—Cooper, Dunham, Clark, Griffin & Moran

[57] ABSTRACT

An external housing for an exhaust muffler comprising at least one pipe section having one seamlessly converging end and at least one connecting piece seamlessly extending from the converging end, produced as a one-piece extrusion molded body of a malleable aluminum alloy. The housing may include a second pipe section joined undetachably to the first in alignment therewith. A seating part, e.g., a pipe socket, may be formed integrally with the converging end of the pipe section, projecting from that end into the interior of the pipe section.

6 Claims, 2 Drawing Figures

EXTERNAL HOUSING FOR AN EXHAUST MUFFLER FOR INTERNAL COMBUSTION ENGINES

BACKGROUND OF THE INVENTION

This invention relates to an external housing for an exhaust muffler for internal combustion engines, comprising at least one pipe section which has at one end a seamlessly merging bottom and at least one connecting piece likewise seamlessly therefrom.

The exhaust muffler according to the invention is to be used preferentially on motor vehicles.

In a known external housing of the assumed kind (described in German [Fed. Rep.] Offenlegungsschrift No. 25 20 301), the bottom and the connecting piece starting therefrom are formed in one piece on the pipe section in question by tapering the respective end of the pipe section by swaging. The swaging can be done over a mandrel or also without a mandrel in a cold shaping or hot shaping operation. This known external housing has several disadvantages. Not only does the shaping of the pipe socket by swaging require expensive tools for exact production; it is also labor-intensive and complicated. The bottom can extend conically outward only to an angle of about 45°, so that the production of other forms for the bottom, e.g. a bottom extending substantially perpendicular to the pipe axis, is not possible with the known manufacturing methods.

An exhaust muffler for internal combustion engines has become known (described in German [Fed. Rep.] Offenlegungsschrift No. 26 53 732) wherein the tubular housing consists of an aluminum hollow section made by extrusion. However, in this known exhaust muffler the two end-face housing covers are formed as separate parts, which must be screwed to the tubular base housing. The external housing of the known exhaust muffler thus consists of several differently formed parts which must be assembled. This makes the known design more expensive.

SUMMARY OF THE INVENTION

It is an object of the present invention to provide an external housing for an exhaust muffler for internal combustion engines that is easy and cheap to produce, is made of a material which is especially resistant to corrosion, and which compared with the known designs also results in a saving in weight.

To these and other ends, in accordance with the invention a pipe section with bottom and connecting piece is constituted of a malleable aluminum alloy and is extrusion molded in one piece.

The solution according to the invention permits the production of the pipe socket with bottom and connecting piece in one operation. Compared with the known designs, the manufacturing time and manufacturing costs are thereby reduced. The extrusion molded method moreover permits any desired shape of the bottom and of the connecting piece or pieces. The latter may also be in any desired arrangement relative to the bottom. In fact, the connecting pieces may protrude inwardly as well as outwardly and/or be arranged concentric or eccentric relative to the pipe axis. The malleable aluminum alloys that can be used are highly resistant to corrosion, so that the external housing according to the invention excels by a long life. The external housing according to the invention may be made with relatively thin walls. The screw connections for the bottom and cover normally required for multi-part external housing are obviated. This makes the external housing according to the invention outstanding for its light weight.

Expedient developments of the invention are evident from the following description.

Extrusion molding offers broad possibilities of configuration; the pipe sections may have round, oval or rectangular cross section, and on the outside of the pipe sections cooling fins may be formed in one piece.

The external housing according to the invention may comprise at least two mutually aligned pipe sections. The two end sections may then be formed according to the invention. But it is conceivable also that one end or central pipe section is formed only cylindrically. In the case where the external housing according to the invention comprises at least two pipe sections fitted together in alignment, it is of advantage that the pipe sections are joined together undetachably by rabbeting or welding. In such a form of realization it is expedient to rabbet an intermediate bottom into the jointing plane of two joined pipe sections. This intermediate bottom need not necessarily be made of an aluminum alloy but may be of steel.

If the external housing according to the invention comprises only one pipe section, it is expedient to close the other end of the pipe section by a cover which in turn has one or more connecting pieces. The connection between cover and pipe socket may have any form and may be, e.g., a screw connection.

The broad possibilities of fabrication in aluminum extrusion molding make it possible to select the form of the bottom at will. It may be conical, arched, or flat.

According to another especially preferred form of realization of the solution of the invention, at least one seating part directed into the pipe interior is integrally formed in one piece on the bottom of the pipe section exclusively or along with at least one outwardly protruding connecting piece. This seating part serves to fix a perforated pipe disposed in the interior of an exhaust muffler, a noise-absorbing material being embedded between the outer wall of said pipe and the inner wall of the external housing.

The described seating part is expediently formed as a pipe socket. In this case it is of advantage in terms of manufacture to arrange the outer connecting piece and the inner pipe socket aligned with each other. Alternatively, several such connecting pieces and pipe sockets may be provided.

Lastly, it is of advantage if the inner pipe socket is formed so that subsequent shaping, e.g., in the form of a Venturi tube, is possible.

Further features and advantages of the invention will be apparent from the detailed description hereinbelow set forth together with the accompanying drawings.

DETAILED DESCRIPTION

Figure 1:
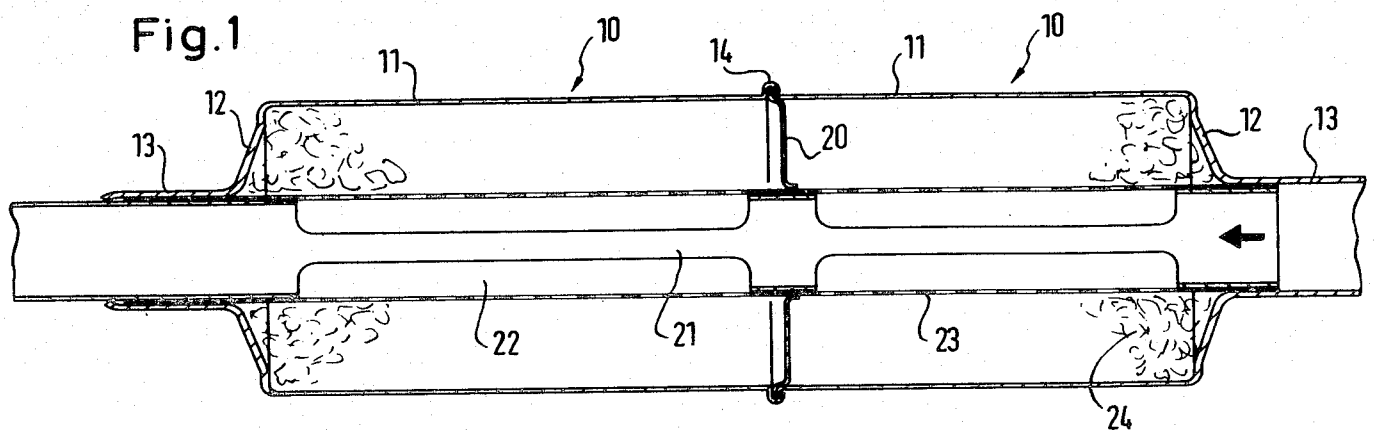
FIG. 1 shows a longitudinal section through an exhaust muffler with an external housing according to the invention, the external housing itself as well as the other structural parts of an exhaust muffler being represented merely schematically.

According to FIG. 1, the external housing for an exhaust muffler for internal combustion engines comprises two substantially identical pipe sections, marked 10 as a whole. Each pipe section 10 comprises a cylindrical part 11, which at one end changes over seamlessly into a bottom 12. From this bottom 12 starts a connecting piece 13, likewise seamlessly. Each of the pipe sections 10 with bottom 12 and connecting piece 13 is constructed of a malleable aluminum alloy and is made in one piece by extrusion molding. The two pipe sections 10 are joined together undetachably by a rabbet 14.

The internal parts of the exhaust muffler according to FIG. 1, indicated only schematically, are known in themselves and therefore require only a short elucidation. Between the two pipe sections 10, an intermediate bottom 20 is fitted into the rabbet 14. Into the connecting piece 13 a pipe 21 is inserted which has passage openings 22 and over which a perforated pipe 23 is fitted. Between this perforated pipe 23 and the inner wall of the pipe sections 10 a sound-absorbing material 24 is introduced.

Figure 2:
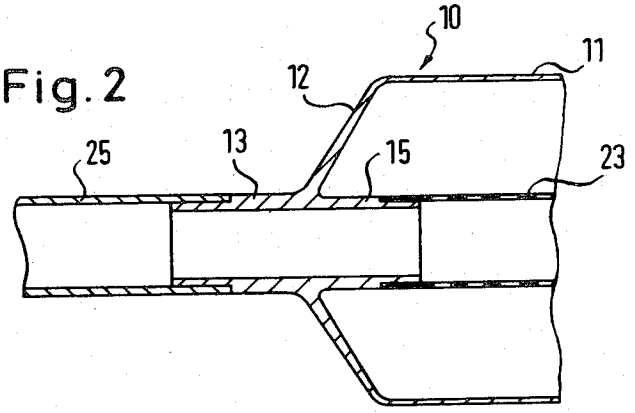
FIG. 2 shows a longitudinal section through one end of a second embodiment of the external housing according to the invention.

FIG. 2 shows a somewhat modified end of a pipe section 10. From the bottom 12 of the pipe section 10 the connecting piece 13 extends outwardly, and additionally a pipe socket 15 extends inwardly, piece 13 and socket 15 being aligned with each other. Such a form can easily be produced by extrusion molding. While an exhaust pipe 25 is fitted on the connecting piece 13, the pipe socket carries the perforated pipe 23.

It is to be understood that the invention is not limited to the features and embodiments hereinabove specifically set forth, but may be carried out in other ways without departure from its spirit.

What is claimed is:

1. An exhaust muffler for internal combustion engines, comprising:

a thin-walled external housing;

at least two connecting pieces respectively disposed at the opposite ends of said housing; and a gas-permeable inner pipe component within said housing extending rigidly between and fixed at its opposite ends to said connecting pieces;

and wherein said housing comprises:

at least one pipe section which has at one end a seamlessly merging bottom, and at least one of said connecting pieces likewise seamlessly starting therefrom, said one pipe section with said bottom and said one connecting piece being of a malleable aluminum alloy extrusion molded in one piece with a relatively thin wall, and being mounted on and supported by said inner pipe component.

2. An exhaust muffler according to claim 1 further comprising cooling fins formed in one piece on the outer surfaces of at least said one pipe section.

3. An exhaust muffler according to claim 1, comprising at least two of said pipe sections fitted together in alignment and joined together undetachably.

4. An exhaust muffler according to claim 3 further comprising an intermediate bottom rabbeted into the jointing plane of said two joined pipe sections.

5. An exhaust muffler according to claim 1 wherein the other end of said one pipe section is closed by a cover, which in turn has one or more connecting pieces.

6. An exhaust muffler according to claim 1, wherein said inner pipe component comprises:

a first pipe having elongated openings therein and with its opposite ends inserted into said connecting pieces; and a second pipe surrounding said first pipe, and having perforations therein cooperating with said elongated openings.

* * * * *